US009428867B2

(12) United States Patent
Harman

(10) Patent No.: US 9,428,867 B2
(45) Date of Patent: Aug. 30, 2016

(54) RAILROAD TIE PLATE DISPENSER

(71) Applicant: Jeffrey Kyle Harman, Hiwassee, VA (US)

(72) Inventor: Jeffrey Kyle Harman, Hiwassee, VA (US)

( * ) Notice: Subject to any disclaimer, the term of this patent is extended or adjusted under 35 U.S.C. 154(b) by 298 days.

(21) Appl. No.: 14/194,948

(22) Filed: Mar. 3, 2014

(65) Prior Publication Data

US 2014/0251175 A1 Sep. 11, 2014

Related U.S. Application Data

(60) Provisional application No. 61/773,341, filed on Mar. 6, 2013.

(51) Int. Cl.
*E01B 29/32* (2006.01)
*E01B 29/24* (2006.01)

(52) U.S. Cl.
CPC ..... *E01B 29/32* (2013.01); *E01B 29/24* (2013.01)

(58) Field of Classification Search
CPC ..... E01B 29/24; E01B 29/32
USPC ..... 104/16
See application file for complete search history.

(56) References Cited

U.S. PATENT DOCUMENTS

| | | | | | |
|---|---|---|---|---|---|
| 3,943,858 | A * | 3/1976 | Dieringer | E01B 29/24 | 104/16 |
| 4,225,429 | A * | 9/1980 | Holley | B03C 1/16 | 104/279 |
| 4,691,639 | A * | 9/1987 | Holley | E01B 29/32 | 104/16 |
| 4,722,283 | A * | 2/1988 | Holley | B65G 17/323 | 104/279 |
| 4,942,822 | A * | 7/1990 | Cotic | E01B 29/32 | 104/16 |
| 4,974,518 | A * | 12/1990 | Cotic | E01B 29/32 | 104/16 |
| 5,142,987 | A * | 9/1992 | Freymuth | E01B 29/32 | 104/17.2 |
| 5,331,899 | A * | 7/1994 | Holley | E01B 29/32 | 104/16 |
| 2010/0224096 | A1* | 9/2010 | Helmick | E01B 29/32 | 104/2 |
| 2011/0100248 | A1* | 5/2011 | Buckley | E01B 29/32 | 104/16 |
| 2011/0146526 | A1* | 6/2011 | Plyler | B03C 1/20 | 104/2 |
| 2012/0204752 | A1* | 8/2012 | Helmick | E01B 29/32 | 104/16 |

* cited by examiner

*Primary Examiner* — Zachary Kuhfuss
(74) *Attorney, Agent, or Firm* — Studebaker & Brackett PC

(57) ABSTRACT

A railroad tie plate dispenser includes a feed chute having a top portion for receiving a stack of railroad tie plates and a push tab at a bottom portion of the feed chute for stripping railroad tie plates from the feed chute through an opening in the feed chute to dispense railroad tie plates from a front side of the feed chute.

19 Claims, 7 Drawing Sheets

RAILROAD TIE PLATE DISPENSER

This invention claims the benefit of U.S. Provisional Patent Application No. 61/773,341 filed on Mar. 6, 2013, which is hereby incorporated by reference in its entirety.

BACKGROUND OF THE INVENTION

1. Field of the Invention

The embodiments of the invention relate to railroad equipment, and more particularly, to railroad equipment for dispensing railroad tie plate. Although embodiments of the invention are suitable for a wide scope of railroad tie plate dispensing applications, it is particularly suitable for dispensing railroad tie plates along a railway to pre-position the railroad tie plates for subsequent maintenance work on the railway.

2. Discussion of the Related Art

In general, a railroad is a pair of parallel rails interconnected by railroad ties that cross the rails along a path of ballast. The rails are interconnected with the railroad ties using railroad tie plates, which are positioned between the rails and the railroad ties. Typically, railroad ties are made of wood but can also be made of reinforced concrete.

Railroad tie plates increase the load bearing surface area on the tie. Accordingly, a load that is transferred from the rail to the railroad tie through the railroad tie plate is spread across a larger surface of the railroad tie than a surface area of the rail on the railroad tie plate. In the past, spikes were used to hold both the railroad tie plates and the rails in position on the ties. Today, spikes or bolts can be used to attach the railroad tie plate to the tie while the rail is attached to the tie plate using a fastener, such as a clip.

Railroads were initially built using hand tools and manual labor. The equipment first used in the railroad construction industry was for clearing and preparing railway beds. Later, purpose built equipment specifically designed for railroad construction was developed and used. Such purpose built equipment can have the ability to ride-on or drive-on the railroads with rail gear mounted on that equipment. Today, the setting of ties, laying of rail, grading of ballast and driving of spikes is all done by railroad construction equipment specifically designed for such tasks. There is also railroad construction equipment that can affect repairs, such as tie replacement equipment that removes a tie from under the rails of an existing railroad track and then inserts a new tie, which is later spiked to a tie plate and then attached to the rails with a clip.

Purpose built railroad construction equipment is typically supported by other material handling equipment. For example, front-end loaders and dump trucks used to preposition ballast for the railway ballast grading equipment. In another example, excavators with mechanical claws preposition ties for the railway tie setting equipment. However, manual labor is still used to preposition railroad tie plates for the railroad tie plate installation equipment. That is, manual labor is done to specifically position railroad tie plates adjacent to the ends of a tie such that railroad tie plate installation equipment can later come along and acquire the railroad tie plate and install the railroad tie plates between the ties and the rails. The placement of railroad tie plates by hand, so as to effectively preposition railroad tie plates for a machine to then later install railroad tie plates, can literally be considered back breaking work.

SUMMARY OF THE INVENTION

Accordingly, embodiments of the invention is directed to railroad equipment for dispensing railroad tie plate that substantially obviates one or more problems due to limitations and disadvantages of the related art.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

An object of embodiments of the invention is to provide a device for propositioning railroad tie plates along railways.

Another object of embodiments of the invention is to provide a device that dispenses railroad tie plates at predetermined intervals along a railway.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, a railroad tie plate dispenser includes: a feed chute having a top portion for receiving a stack of railroad tie plates; and a push tab at a bottom portion of the feed chute for stripping railroad tie plates from the feed chute through an opening in the feed chute to dispense railroad tie plates from a front side of the feed chute.

In another aspect, a railroad tie plate dispenser includes: a feed chute for receiving a stack of railroad tie plates; a pair of drop paddles at a top portion of the feed chute for squarely dropping railroad tie plates into the feed chute; and a push tab on a chain at a bottom portion of the feed chute for stripping railroad tie plates from the feed chute through an opening in the feed chute to dispense railroad tie plates from a front side of the feed chute.

In yet another aspect, a railroad tie plate dispenser includes: a feed chute having a top portion for receiving a stack of railroad tie plates; a first sprocket at the front side of the bottom portion of the feed chute; a second sprocket at a rear side of the bottom portion of the feed chute, which is opposite to the front side of the bottom portion of the feed chute; a chain on the first and second sprockets; a push tab on the chain at the bottom portion of the feed chute for stripping railroad tie plates from the feed chute through an opening in the feed chute to dispense railroad tie plates from a front side of the feed chute; and guide rails at the opening in the feed chute and protruding from the feed chute for squarely guiding railroad tie plates stripped from the feed chute.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention.

DETAILED DESCRIPTION OF THE PREFERRED EMBODIMENTS

Figure 1:
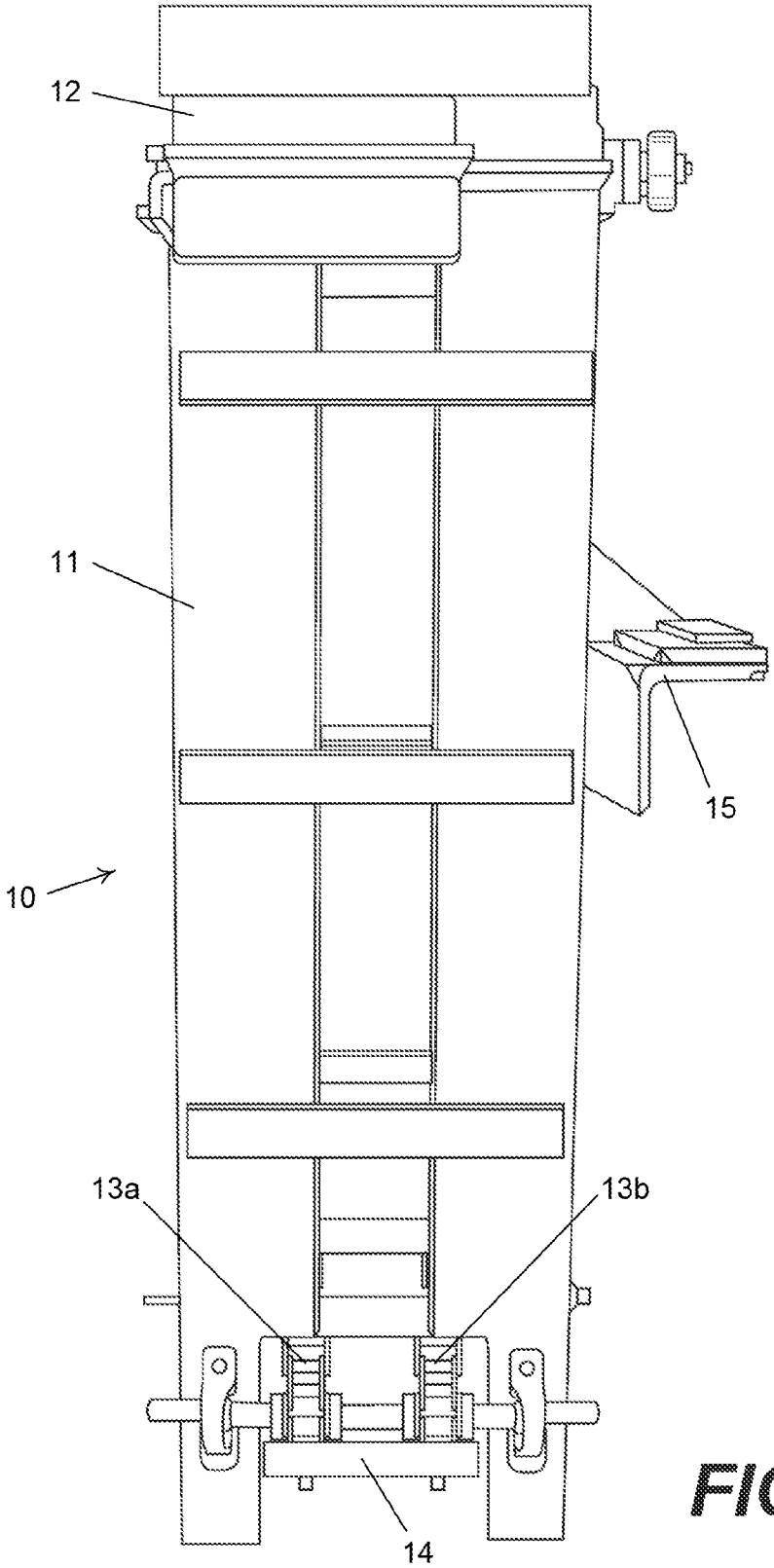
FIG. 1 is a rear view of a railroad tie plate dispenser according to an exemplary embodiment of the invention.

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity. Like reference numerals in the drawings denote like elements.

FIG. 1 is a rear view of a railroad tie plate dispenser according to an exemplary embodiment of the invention. As shown in FIG. 1, a railroad tie plate dispenser 10 includes: a feed chute 11 for holding a stack of railroad tie plates, paddle wheels 12 at the top portion of the feed chute 11 for stacking railroad tie plates and roller chains 13*a* and 13*b* with push tabs 14 at the bottom portion of the feed chute 11 for dispensing the railroad tie plates. A bracket 15 near the middle of the feed chute 11 is used for mounting the railroad tie plate dispenser 10 onto a railway traversing vehicle.

The railroad tie plate dispenser generally has two operations. First, the paddle wheels 12 are actuated to individually drop the railroad plates flatly into the feed chute 11 to form a stack of railroad tie plates. Second, the roller chains 13*a* and 13*b* with the push tabs 14 are moved such that the push tabs 14 just push the bottom railroad tie plate of the stack of railroad tie plates out of the feed chute 11 such that railroad tie plates will flip onto the ground at an interval.

Figure 2A:
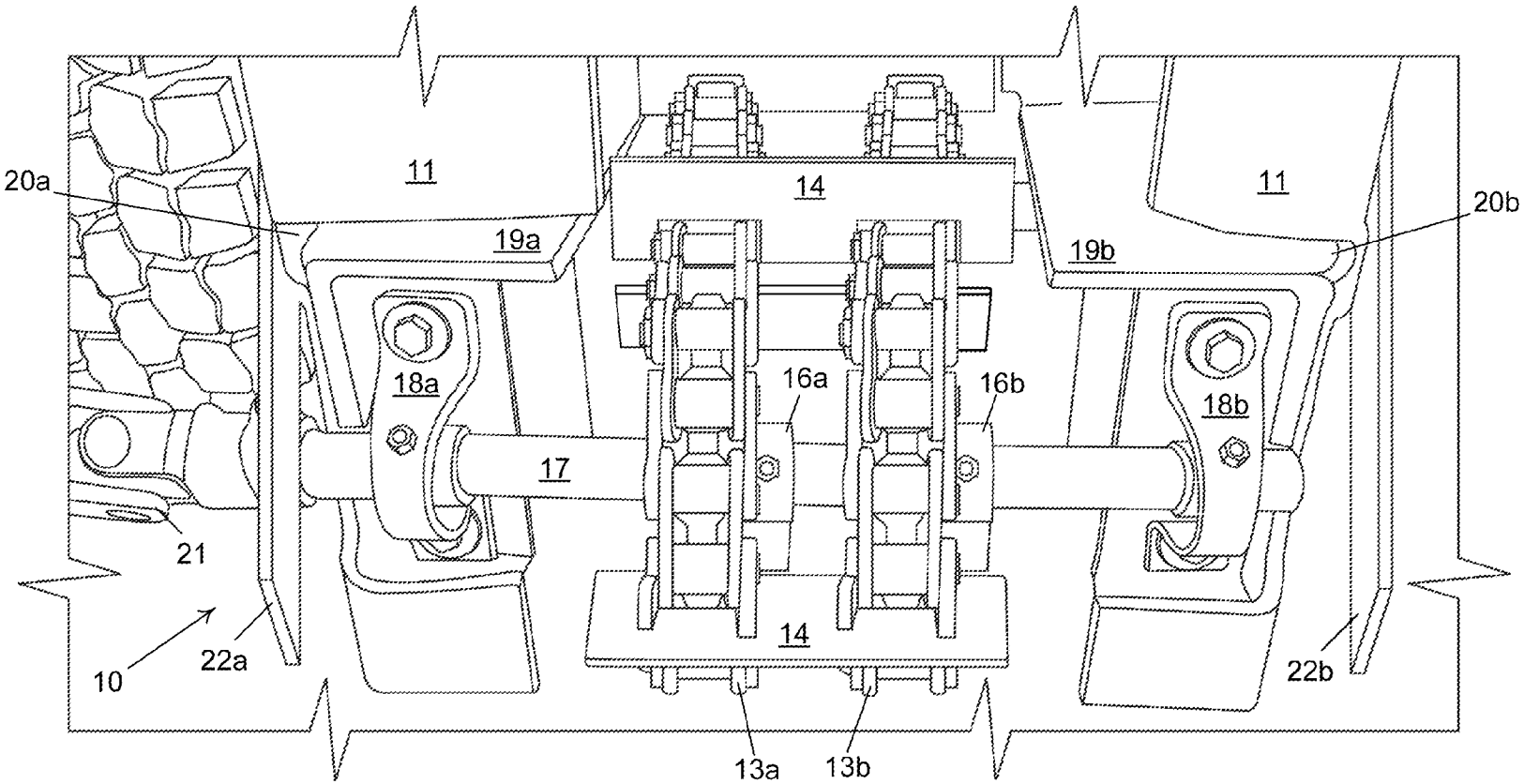
FIG. 2A is a front view of a railroad tie plate dispenser showing the drive sprockets, chains and push tabs according to an exemplary embodiment of the invention.

FIG. 2A is a front view of a railroad tie plate dispenser showing the drive sprockets, chains and push tabs according to an exemplary embodiment of the invention. As shown in FIG. 2A, a roller chain 13*a* is over a drive sprocket 16*a* on a drive shaft 17 and a roller chain 13*b* is over a drive sprocket 16*b* on the drive shaft 17 at the bottom portion of the feed chute 11. The drive shaft 17 rotates in pillar bearings 18*a* and 18*b* attached to the bottom portion of the feed chute 11. The push tabs 14 on roller chains 13*a* and 13*b* traverse through the feed chute 11 between two ledges 19*a* and 19*b* of the feed chute 11 upon which a stack of railroad tie plates (not shown) can rest. More specifically, the push tabs 14 traverse through the feed chute 11 between the two ledges 19*a* and 19*b* toward the openings 20*a* and 20*b* in the feed chute 11. The drive shaft 17 is turned through a universal joint 21 at one end that is driven through a slip joint (not shown) from another universal joint (not shown) connected to the high rail wheel (not shown) of a railway traversing vehicle (not shown). Guide rails 22*a* and 22*b* at the openings 20*a* and 20*b* of the feed chute protrude outwardly from the front of the railroad tie plate dispenser 10 to guide individual railroad tie plates (not shown) while being pushed out the openings 20*a* and 20*b* by a push tab 14.

Figure 2B:
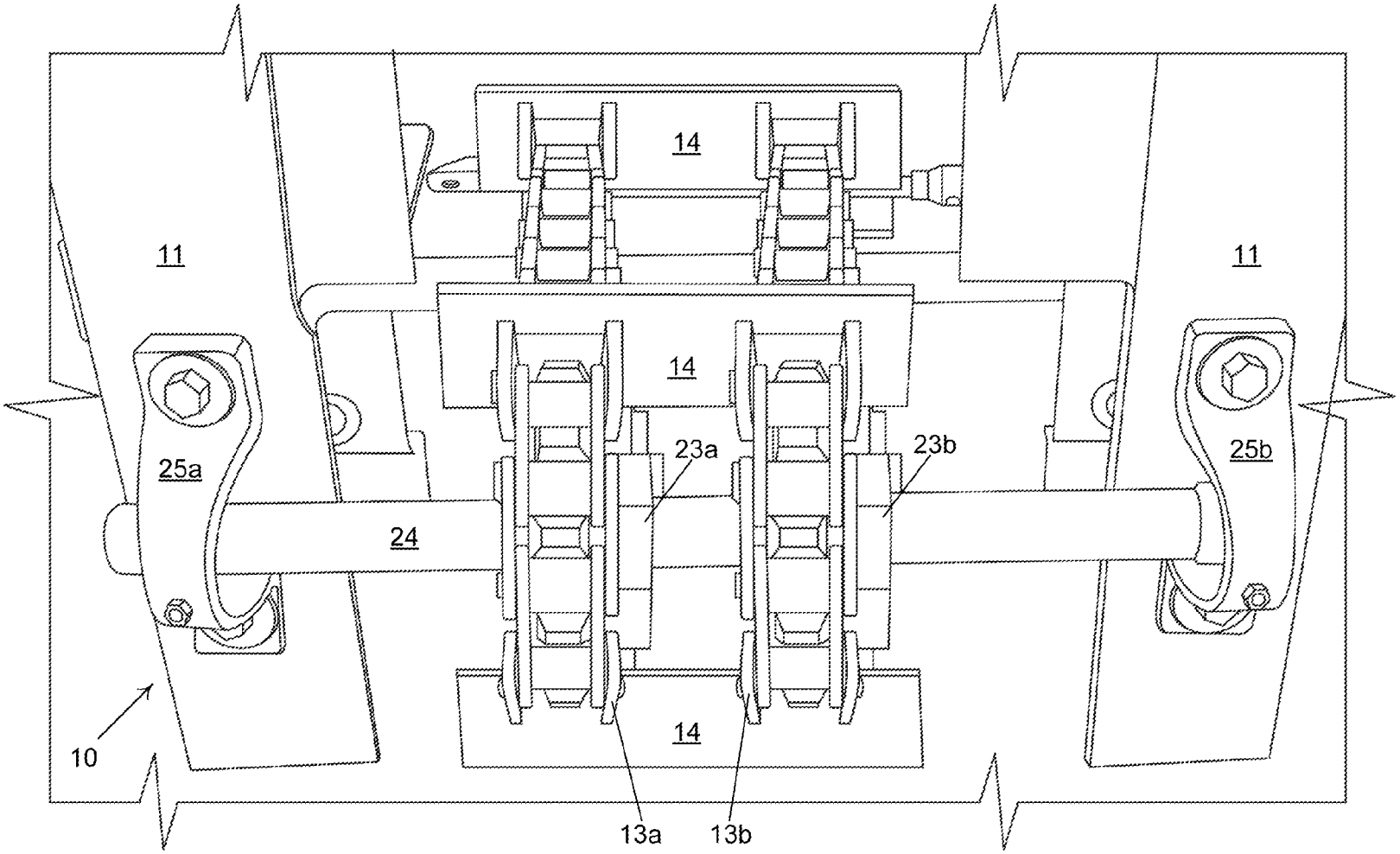
FIG. 2B is a rear view of a railroad tie plate dispenser showing the idler sprockets, chains and push tabs according to an exemplary embodiment of the invention.

FIG. 2B is a rear view of a railroad tie plate dispenser showing the idler sprockets, chains and push tabs according to an exemplary embodiment of the invention. As shown in FIG. 2B, a roller chain 13*a* is over an idler sprocket 23*a* on an idler shaft 24 and a roller chain 13*b* is over an idler sprocket 23*b* on the same idler shaft 24 at the bottom portion of the feed chute 11. The idler shaft 24 rotates in pillar bearings 25*a* and 25*b* attached to the bottom portion of the feed chute 11.

The roller chains 13*a* and 13*b* with push tabs 14 form a conveyor from the idler shaft 24 to the drive shaft 17. Each push tab 14 on the roller chains 13*a* and 13*b* can strip a bottom railroad tie plate from a stack of railroad tie plates (not shown) in the feed chute 11. The, the next push tab 14 on the roller chains 13*a* and 13*b* can strip the next bottom railroad tie plate from the stack of railroad tie plates (not shown) in the feed chute 11. As a railroad tie plate is stripped from the stack of railroad tie plates (not shown) in the feed chute 11, the push tab 14 together with the guide rails 22*a* and 22*b*, as shown in FIG. 2A, guide the railroad tie plate (not shown) squarely out of the feed chute 11. Just after the railroad tie plate (not shown) clears the feed chute 11 by being pushed by a push tab 14, the railroad tie plate flips 180° off of the ends of the roller chains 13*a* and 13*b* due to gravity so that the railroad tie plate flips onto the railway bed.

Although the exemplary embodiment shown in FIGS. 2A and 2B discloses a single push tab on two chains stripping a railroad tie plate from a stack of railroad tie plates in feed chute, other embodiments are encompassed by the present invention. For example, a single push tab on a single chain can be used to strip a railroad tie plate from a stack of railroad tie plates in the feed chute. In another example, a first push tab on a first chain together with a second push tab on second chain can be both used together to strip a railroad tie plate from a stack of railroad tie plates in the feed chute.

Figure 3:
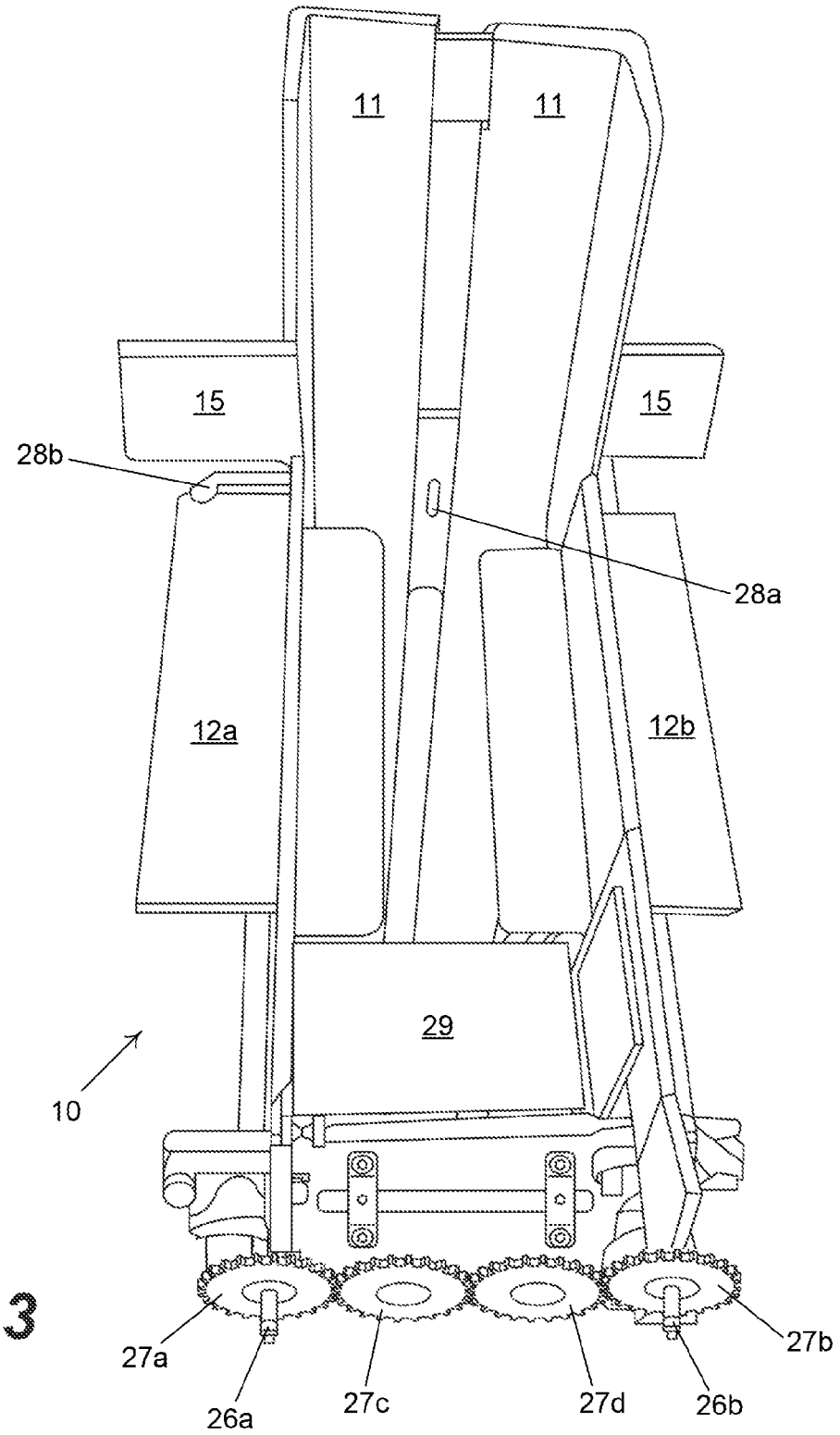
FIG. 3 is a top view of a railroad tie plate dispenser according to an exemplary embodiment of the invention.

FIG. 3 is a top view of a railroad tie plate dispenser according to an exemplary embodiment of the invention. As shown in FIG. 3, the railroad tie plate dispenser 10 includes a pair of paddle wheels 12*a* and 12*b* at the top of the feed chute 11. Each of the pair of paddle wheels 12*a* and 12*b* has four drop paddles. The paddle wheel 12*a* at one side of the feed chute 11 rotates about a spindle 26*a* and has a gear 27*a* attached to the spindle 26*a*. The other paddle wheel 12*b* at the other side of the feed chute 11 rotates about another spindle 26*b* and has a gear 27*b* attached to the spindle 26*b*. Two other gears 27*c* and 27*d* are intermeshed with each other and positioned between the gears 27*a* and 27*b* on the spindles 26*a* and 26*b* such that all of the gears 27*a*, 27*b*, 27*c* and 27*d* are all intermeshed. Accordingly, the paddle wheels 12*a* and 12*b* are geared to spin in opposite directions concurrently. Although paddle wheels 12*a* and 12*b* are shown in FIG. 3, a single pair of drop paddles geared together with a spring return can be alternatively used instead of paddle wheels.

The feed chute 11 shown in FIG. 3 is filled with railroad tie plates by individually sliding the railroad tie plates onto the drop paddle of the paddle wheels 12*a* and 12*b*. After a railroad tie plate slides onto the pair of drop paddles, the railroad tie plate then hits the trigger tab 28*a*. Upon impact of the trigger tab 28*a*, the release tab 28*b* is pushed back to enable the drop paddles to consecutively rotate due to the weight of the railroad tie plate on the drop paddles so that the railroad tie plate drops squarely into the feed chute. As a railroad tie plate drops, the spring loaded trigger tab 28*a* is released such that the release tab 28*b* will catch the next drop paddle and stop rotation of the paddle wheels 12. As discussed above, the paddle wheels rotate concurrently to squarely drop a railroad tie plate into the feed chute 11 because of the meshed gears 27*a*, 27*b*, 27*c* and 27*d*.

In the exemplary embodiment of FIG. 3, either 18 inch railroad tie plates or 14.75 inch railroad tie plates can be dispensed. In the case of dispensing 14.75 inch railroad tie plates, a spacer 29 is inserted into the feed chute 11 to reduce the interior length dimension of the feed chute 11 by 3.0 inches. The spacer 29 can be a box beam with a flat top surface slightly higher than the drop paddles of the paddle wheels 12*a* and 12*b* in the top portion of the feed chute 11, as shown in FIG. 3. The spacer 29 has a top surface slightly higher than the drop paddles of the paddle wheels 12*a* and 12*b* such that the railroad tie plates can be slid across the top surface of the spacer and then onto the drop paddles of the paddle wheels 12*a* and 12*b*. There is no spacer 29 in feed chute 11 for dispensing 18 inch railroad tie plates. Other size spacers can be used for other sizes of railroad tie plates. However, shorter paddle wheels may have to be installed for smaller sizes of railroad tie plates. Further, a temporary guide rail (not shown) may be clamped onto guide rail 22*a* when a spacer 29 is used in the feed chute 11. Such a temporary guide rail should have about the same width as the spacer 29 used.

Figure 4:
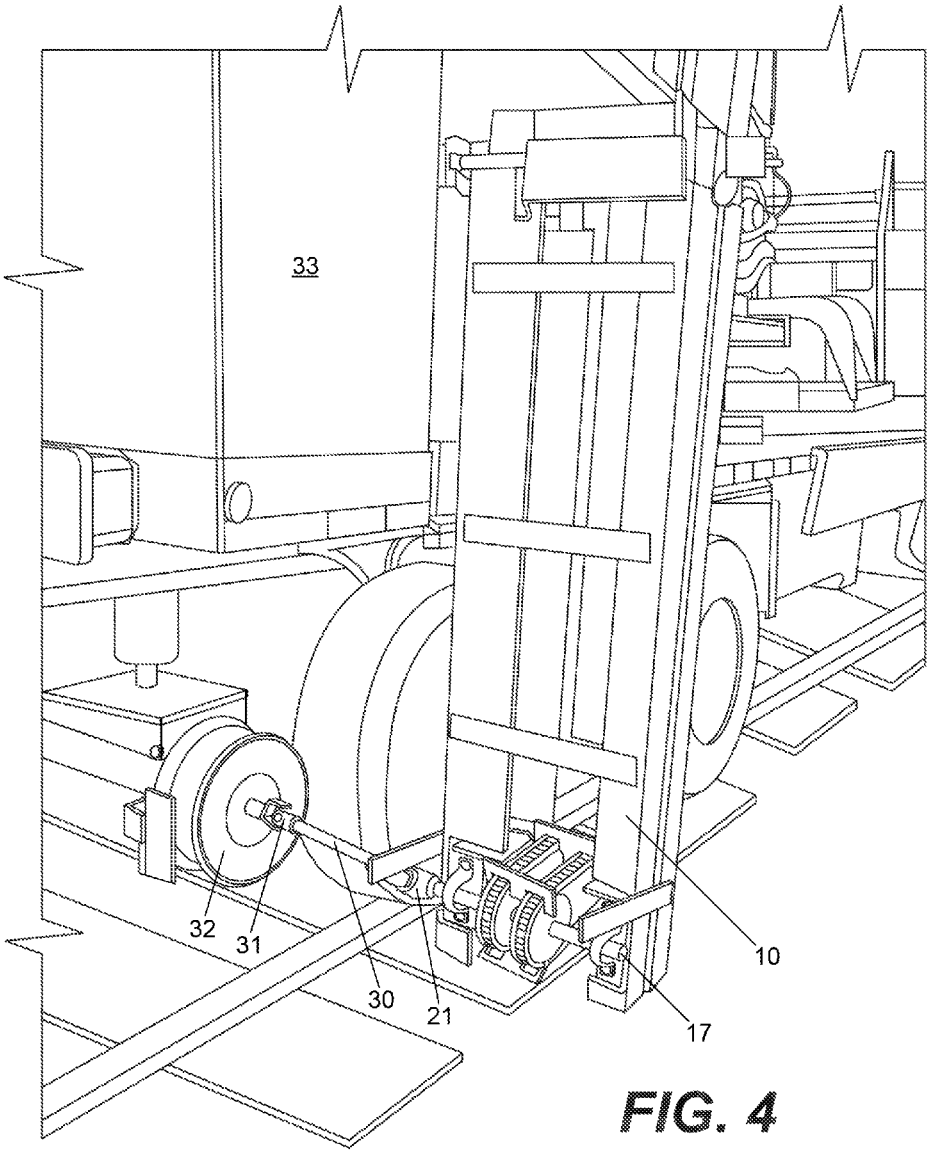
FIG. 4 is a perspective view of a railroad tie plate dispenser mounted on railway traversing vehicle according to an exemplary embodiment of the invention.

FIG. 4 is a perspective view of a railroad tie plate dispenser mounted on railway traversing vehicle according to an exemplary embodiment of the invention. As shown in FIG. 4, a railroad tie plate dispenser 10 can be mounted on the side of a railway traversing vehicle 33. Further, the drive shaft 17 of the railroad tie plate dispenser 10 can be coupled to the rail gear 32 of the railway traversing vehicle 33. Thus, the drive shaft 17 is turned through a universal joint 21 at one end through a slip joint 30 from another universal joint 31, which is connected to the high rail wheel 32 of the railway traversing vehicle 33. Thus, the drive shaft of the railroad tie plate dispenser 10 will turn as the high rail wheel 32 of the railway traversing vehicle 33.

Figure 5:
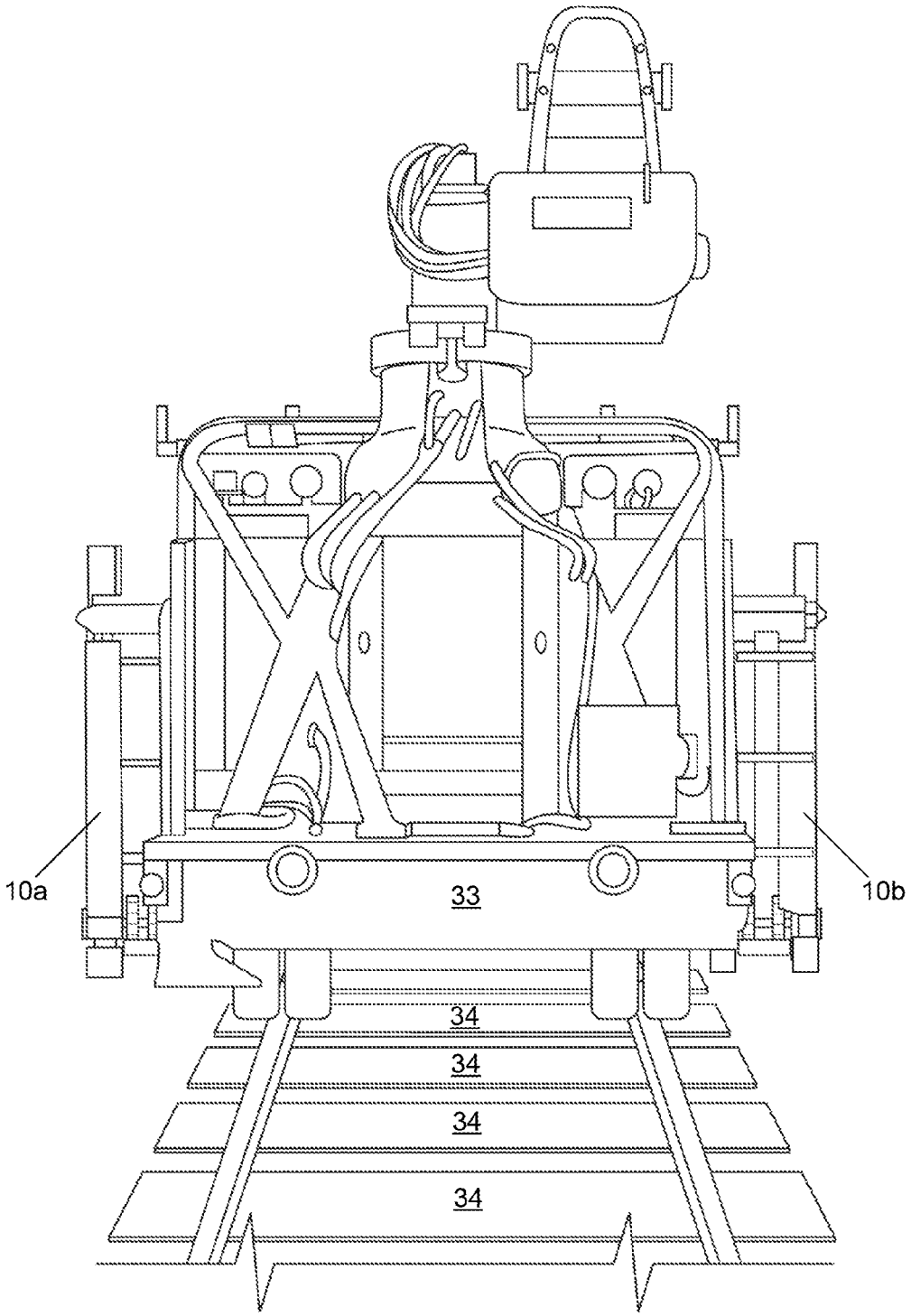
FIG. 5 is a rear view of two railroad tie dispensers mounted on a railway traversing vehicle according to an exemplary embodiment of the invention.

FIG. 5 is a rear view of two railroad tie dispensers mounted on a railway traversing vehicle according to an exemplary embodiment of the invention. As shown in FIG. 5, a first railroad tie plate dispenser 10*a* can be mounted on one side of a railway traversing vehicle 33 and a second railroad tie plate dispenser 10*b* can be mounted on the other side of the railway traversing vehicle 33. Because the rail gear of the railway traversing vehicle is attached to the drive shafts of both the first and second railroad tie plate dispensers, the roller chains with push tabs of the two railroad tie dispensers can both concurrently strip railroad tie plates from each stack of railroad tie plates in each of the feed chutes. Thus, railroad tie plates can be dispensed concurrently along both sides of a railway at predetermined intervals. The interval for dispensing railroad tie plates is determined by the positions of the push tabs on the roller chain, the length of the roller chain, the diameter of the drive sprocket on the drive shaft and the diameter of the idler sprocket on the idler shaft.

Figure 6:
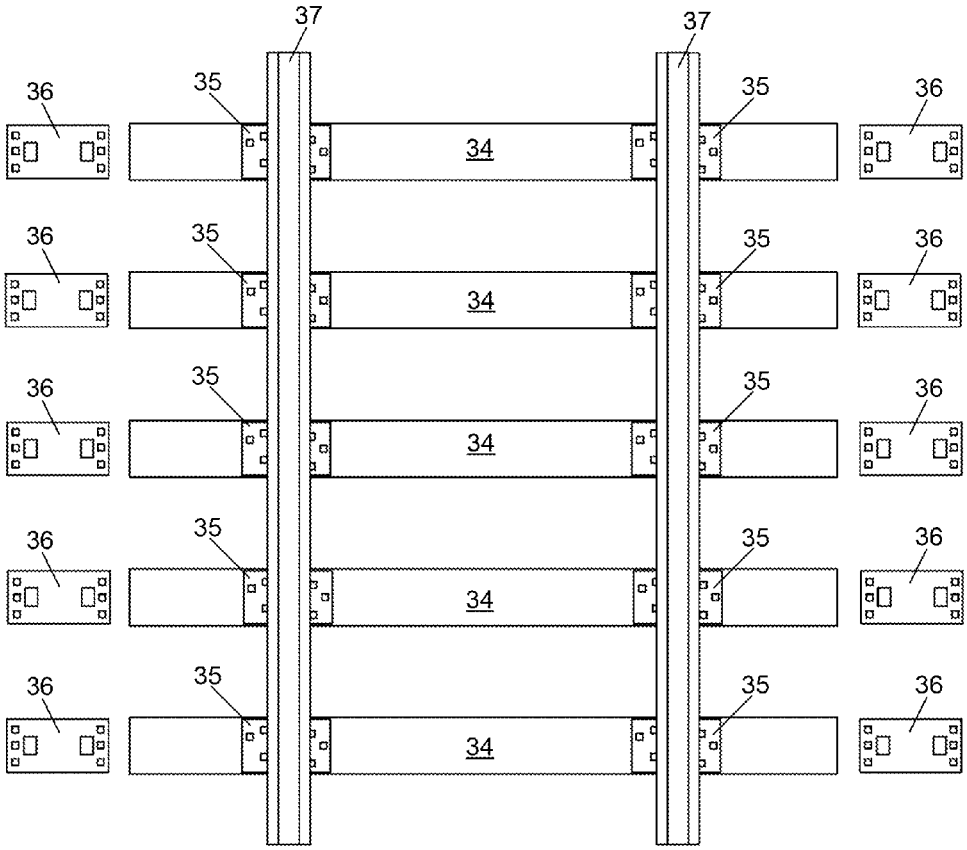
FIG. 6 is a top view of railway with dispensed railroad tie plates.

FIG. 6 is a top view of railway with dispensed railroad tie plates. As shown in FIG. 6, the dispensed railroad tie plates 36 are flipped down adjacent to the ends of the ties 34. Subsequently, railroad tie plate installation equipment can come along, remove the old railroad tie plates 35 and install the dispensed railroad tie plates 36 between the ties 34 and the rails 37.

It will be apparent to those skilled in the art that various modifications and variations can be made in the embodiments of the invention without departing from the spirit or scope of the invention. Thus, it is intended that embodiments of the invention cover the modifications and variations of this invention provided they come within the scope of the appended claims and their equivalents.

What is claimed is:

1. A railroad tie plate dispenser, comprising:

a feed chute having a top portion for receiving a stack of railroad tie plates; and a push tab at a bottom portion of the feed chute for stripping railroad tie plates from the feed chute through an opening in the feed chute to dispense railroad tie plates from a front side of the feed chute, wherein the push tab is on a chain.

2. The railroad tie plate dispenser according to claim 1, further comprising: a first sprocket at the front side of the bottom portion of the feed chute; and a second sprocket at a rear side of the bottom portion of the feed chute, which is opposite to the front side of the bottom portion of the feed chute, wherein the chain is on the first and second sprockets.

3. The railroad tie plate dispenser according to claim 2, wherein the push tab is on two chains.

4. The railroad tie plate dispenser according to claim 1, further comprising: guide rails at the opening in the feed chute and protruding from the feed chute for squarely guiding railroad tie plates stripped from the feed chute.

5. The railroad tie plate dispenser according to claim 4, wherein the top portion of the feed chute further comprises at least pair of drop paddles for squarely dropping railroad tie plates into the feed chute.

6. The railroad tie plate dispenser according to claim 5, wherein each of the pair of drop paddles is a paddle of a paddle wheel.

7. The railroad tie plate dispenser according to claim 5, further comprising: a spacer positioned in the feed chute, wherein the spacer has a top surface higher than the drop paddles.

8. A railroad tie plate dispenser, comprising:

a feed chute for receiving a stack of railroad tie plates;

a pair of drop paddles at a top portion of the feed chute for squarely dropping railroad tie plates into the feed chute; and a push tab on a chain at a bottom portion of the feed chute for stripping railroad tie plates from the feed chute through an opening in the feed chute to dispense railroad tie plates from a front side of the feed chute.

9. The railroad tie plate dispenser according to claim 8, wherein the chain has a plurality of push tabs.

10. The railroad tie plate dispenser according to claim 8, further comprising: a first sprocket at the front side of the bottom portion of the feed chute; and a second sprocket at a rear side of the bottom portion of the feed chute, which is opposite to the front side of the bottom portion of the feed chute, wherein the chain is on the first and second sprockets.

11. The railroad tie plate dispenser according to claim 8, wherein each of the pair of drop paddles is a drop paddle wheel.

12. The railroad tie plate dispenser according to claim 8, wherein the push tab is on two chains.

13. The railroad tie plate dispenser according to claim 8, further comprising: guide rails at the opening in the feed chute and protruding from the feed chute for squarely guiding railroad tie plates stripped from the feed chute.

14. The railroad tie plate dispenser according to claim 8, further comprising: a spacer positioned in the feed chute, wherein the spacer has a top surface higher than the drop paddles.

15. A railroad tie plate dispenser, comprising:

a feed chute having a top portion for receiving a stack of railroad tie plates;

a first sprocket at the front side of the bottom portion of the feed chute;

a second sprocket at a rear side of the bottom portion of the feed chute, which is opposite to the front side of the bottom portion of the feed chute;

a chain on the first and second sprockets;

a push tab on the chain at the bottom portion of the feed chute for stripping railroad tie plates from the feed chute through an opening in the feed chute to dispense railroad tie plates from a front side of the feed chute; and guide rails at the opening in the feed chute and protruding from the feed chute for squarely guiding railroad tie plates stripped from the feed chute.

16. The railroad tie plate dispenser according to claim 15, wherein the push tab is on two chains.

17. The railroad tie plate dispenser according to claim 15 wherein the top portion of the feed chute further comprises at least pair of drop paddles for squarely dropping railroad tie plates into the feed chute.

18. The railroad tie plate dispenser according to claim 17, wherein each of the pair of drop paddles is a paddle of a paddle wheel.

19. The railroad tie plate dispenser according to claim 17, further comprising: a spacer positioned in the feed chute, wherein the spacer has a top surface higher than the drop paddles.

* * * * *